US005609302A

United States Patent [19]

Smith

[11] Patent Number: 5,609,302

[45] Date of Patent: Mar. 11, 1997

[54] REMOVABLE SPRAY GUN FLUID FLOW ASSEMBLY

[76] Inventor: William C. Smith, 7701 Whiterim Ter., Potomac, Md. 20854

[21] Appl. No.: 425,083

[22] Filed: Apr. 19, 1995

[51] Int. Cl.[6] ..... B05B 15/02; B05B 7/12

[52] U.S. Cl. ..... 239/526; 239/600

[58] Field of Search ..... 239/525–527, 239/600

[56] References Cited

U.S. PATENT DOCUMENTS

| | | | |
|---|---|---|---|
| 3,633,828 | 1/1972 | Larson | 239/526 X |
| 3,796,376 | 3/1974 | Farnsteiner | 239/353 |
| 3,831,862 | 8/1974 | Calder | 239/526 X |
| 4,456,180 | 6/1984 | Lury | 239/600 X |
| 4,641,786 | 2/1987 | Moore | 239/600 X |
| 4,817,872 | 4/1989 | Mattson | 239/300 |
| 5,199,649 | 4/1993 | Tolboll | 239/600 |

FOREIGN PATENT DOCUMENTS

| | | | |
|---|---|---|---|
| 517388 | 12/1992 | European Pat. Off. | 239/600 |

*Primary Examiner*—Kevin Weldon
*Attorney, Agent, or Firm*—William S. Ramsey

[57] ABSTRACT

Frequent cleaning, maintenance, and or replacement of spray guns is necessary for good performance, but cleaning is often neglected because of difficulty in reaching the crucial parts to be cleaned. The spray gun of this invention has a fluid flow assembly which may be readily removed to facilitate cleaning. In addition, this spray gun has an external fluid flow assembly packing gland adjustment nut, which allows frequent convenient adjustment of the packing gland without disassembly of the spray gun. This allows the user to maintain free movement of the needle valve shaft while preventing leakage of fluid into the spray gun body.

2 Claims, 4 Drawing Sheets

Fig. 5
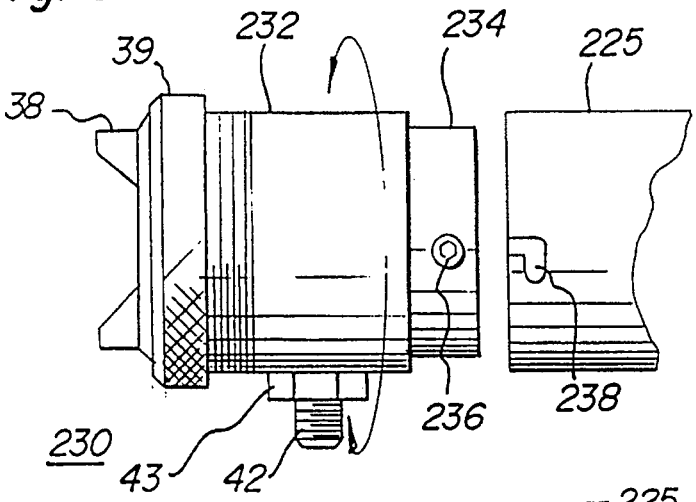
Fig. 6
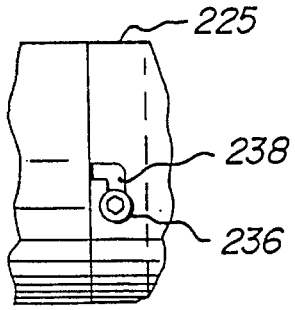
Fig. 7
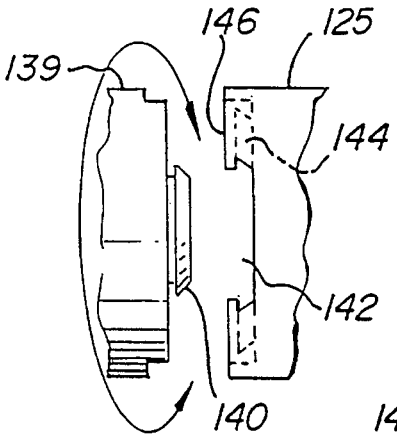
Fig. 8
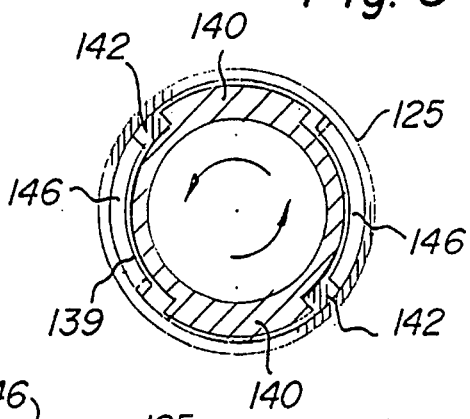
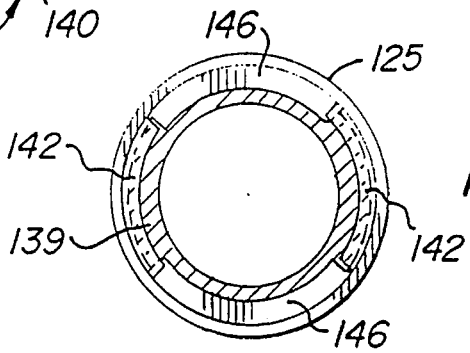
Fig. 9

REMOVABLE SPRAY GUN FLUID FLOW ASSEMBLY

BACKGROUND OF THE INVENTION

1. Field of the Invention

This invention relates to spray guns, more particularly of the type in which a liquid such as paint is sprayed by the action of compressed air that arrives through the hollow handle of the spray gun to entrain and atomize the liquid.

2. Description of Related Art

The central mechanism in a spray gun is the liquid fluid flow assembly. The assembly conducts the fluid from a fluid container such as a fluid cup, pressure pot, or reciprocating or diaphragm pump. The pressurized fluid, such as paint, flows into a fluid block, generally makes a right angle turn, then flows around the shaft of a needle valve to the nozzle. The flow is controlled by a needle valve, the shaft portion of the needle which transfixes the fluid block and the point portion of the needle which interacts with the nozzle. Retraction of the needle withdraws the point from the nozzle and allows fluid to be sprayed from the nozzle. Engagement of the needle point with the nozzle closes the valve and prevents the flow of fluid.

Three portions of the fluid flow assembly require special maintenance and cleaning. 1. The point of the needle valve and the nozzle with which it interacts must be kept scrupulously clean of caked and dry paint and other dried sprayed materials. Failure to keep this portion clean results in failure of the needle valve to seat properly and leakage of paint from the nozzle tip. 2. The packing which surrounds the needle shaft as it passes into the fluid block must be kept properly tightened and clean of dried paint. Failure to properly tighten the packing results in either prevention of movement of the needle valve or leakage of pressurized paint into the body of the spray gun. Paint in the gun body will mix with atomizing air and will block the air passages in the air cap, causing distorted fan patterns. Paint in the gun body also will cause trigger malfunction. 3. The fluid passage in the fluid block through which the fluid and needle valve shaft passes also must be kept clean or the passage of fluid will be impaired.

Most spray guns do not have a fluid flow assembly which may be removed for cleaning,maintenance or replacement. It is particularly difficult to clean, maintain or replace, and adjust the fluid block packing gland. The packing gland, consisting of one or more gaskets and an adjusting nut, functions to prevent leakage of fluid back past the needle valve shaft into the body of the gun. It is important that the packing gland be adjusted so that it is tight enough to prevent retrograde flow of the pressurized fluid, yet loose enough to allow free movement of the needle valve shaft. Most spray guns often suffer blockage from paint leaked through the packing gland. In addition, failure to properly clean the needle valve point and nozzle often results in leakage of fluid from the nozzle. An unclean needle nozzle also causes the paint to "spit" or squirt, causing unsatisfactory finish and quality of the surface coated. Some spray guns have fluid flow assemblies which may be removed for cleaning. None of the prior art spray guns, however, have such assemblies which are easily removed, allow easy adjustment of movement of the needle valve, and are inexpensive to manufacture.

U.S. Pat. No. 3,796,376 discloses a spray gun having a conventional fluid flow assembly including a needle valve, a stuffing box, and a nozzle. The fluid flow assembly, however, is removable but complicated and difficult to remove.

U.S. Pat. No. 4,817,872 discloses a spray gun having a cylindrical cartridge fluid flow assembly which may be removed for cleaning. The cylindrical assembly has a fitting to which the paint container is attached. The cylindrical assembly fits into the barrel of the gun with the fitting extending through a slot in the barrel. A set screw secures the assembly to the barrel.

None of the prior art spray guns have fluid flow assemblies which are easily removed and cleaned, maintained, or replaced and allow easy adjustment of the packing gland without removal of the assembly, and are simple and inexpensive to manufacture.

SUMMARY OF THE INVENTION

The spray gun improvement of the present invention has a fluid flow assembly which may be easily removed for cleaning maintenance, or replacement. With this spray gun, the entire fluid path may be easily and effectively cleaned. In addition, the packing gland adjustment may be made externally to the spray gun barrel, thus allowing convenient adjustment of the packing gland without disassembly of the spray gun.

One objective of the spray gun is to provide for easy removal of the fluid flow assembly for cleaning.

Another objective is to provide for convenient adjustment of the fluid flow assembly packing gland while the spray gun is assembled.

Another objective is to provide a removable fluid flow assembly which may be mounted in the barrel of a spray gun with or without the use of a gasket to prevent airflow around the body end of the assembly.

Another objective is to provide a spray gun having a removable fluid flow assembly characterized by simple, inexpensive manufacture.

Another objective is to provide a spray gun having the capacity for interchangability to other types of spray heads.

Another objective is to provide a spray gun with the capacity for quick and easy change from one paint color to another.

Another objective is to reduce the emission of volatile organic compounds into the atmosphere through the provision of a spray gun design which minimizes the use of such compounds for cleaning.

A final objective is to provide a fluid flow assembly design adaptable to many spray gun body styles.

BRIEF DESCRIPTION OF THE DRAWINGS

FIG. 5 is a side view of the second embodiment locking system having a L-shaped slot and a boss.

FIG. 6 is a side view showing the second embodiment locking system in the locked position.

FIG. 7 is a side view of the second embodiment locking ring and barrel having a bayonet latch.

FIG. 8 is a diagrammatic view showing the bayonet latch on the locking ring and barrel in the unlatched position.

FIG. 9 is a diagrammatic view showing the bayonet latch on the locking ring and barrel in the latched position.

DESCRIPTION OF THE PREFERRED EMBODIMENTS

Before explaining in detail the present invention it is to be understood that the present invention is not limited in its present application to the details of construction and arrangement of parts illustrated in the accompanying drawings since the invention is capable of other embodiments and of being practiced or carried out in various ways. Also it is understood that the phraseology or terminology employed herein is for purposes of description and not of limitation. Further, it is to be understood, that nozzles or fluid delivery devices of any type or description can be used with the present invention.

The spray gun used to illustrate this invention is a low pressure high volume (LPHV) spray gun in which air at a relatively low pressure (up to 10 psi) and relatively high air volume (up to 30 cfm) is used to spray a fluid. This invention, however, may be used with conventional high pressure low volume (HPLV) methods in which air is used at a relatively high pressure (50–60 psi) and low volume (8–12 cfm). In addition, the improvement of the present invention may be used with airless spray guns in which a high pressure (1800–2400 psi) is used to propel the fluid through a nozzle.

In this disclosure the term "liquid" means liquids such as paints, solvents, lubricants, fuels, pesticides, as well as sprayable flowable powders, such as pigments.

Figure 1:
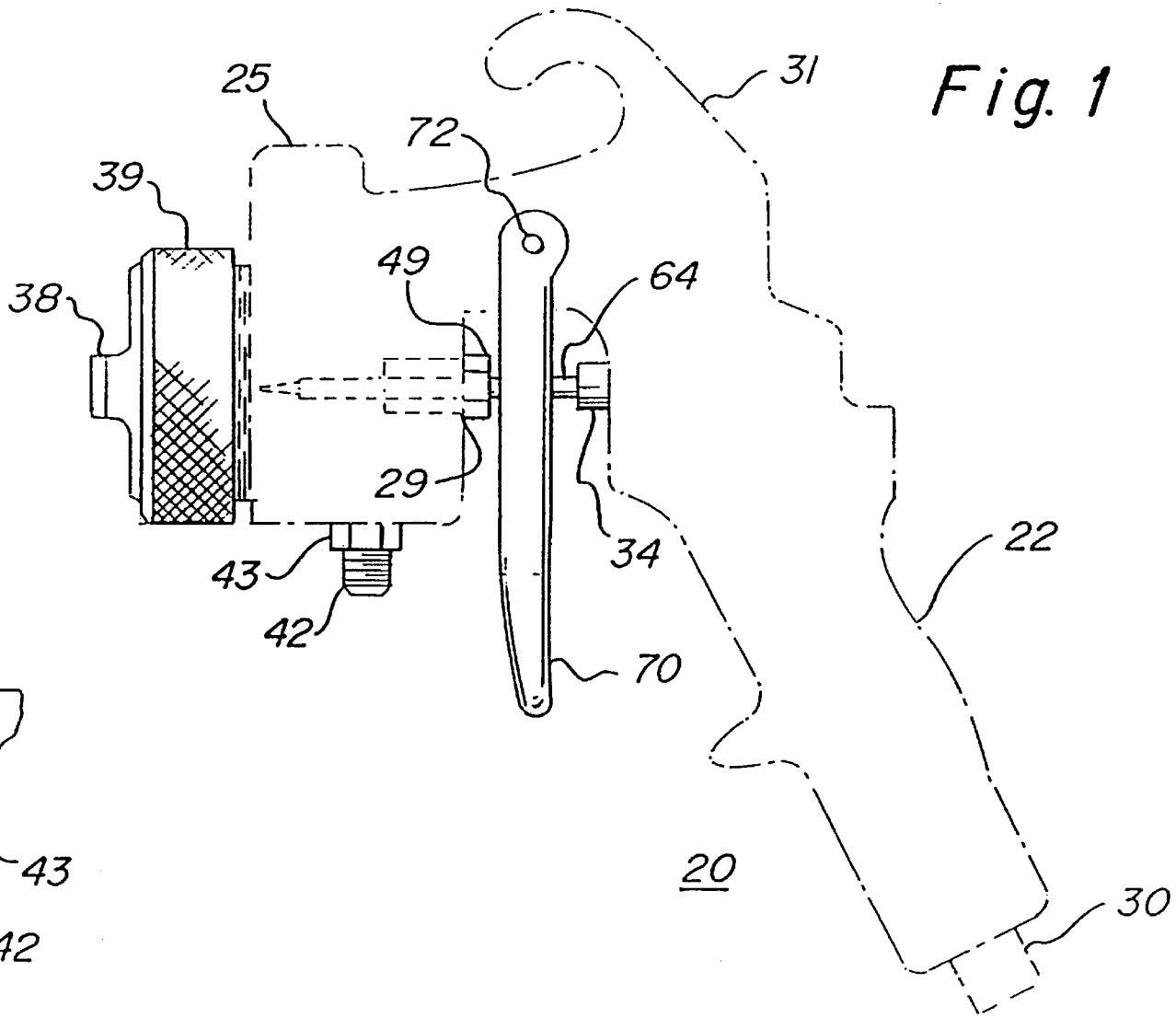
FIG. 1 is a side view of the spray gun.

FIG. 1 is a side view of the first embodiment spray gun of the present invention 20. The spray gun consists of a hollow spray gun handle 22 connected to the hollow spray gun body 31, which is connected to the hollow spray gun barrel 25. An air supply is provided via a air supply fitting 30 at the butt of the handle. Air passes through the handle 22, and through the body 31 and through the barrel 25.

The trigger 70 is supported by and pivots on a trigger mounting pin 72 which extends from each side of the spray gun and interacts with the trigger at a trigger pivot hole 74 formed in each side of the trigger.

Figure 2:
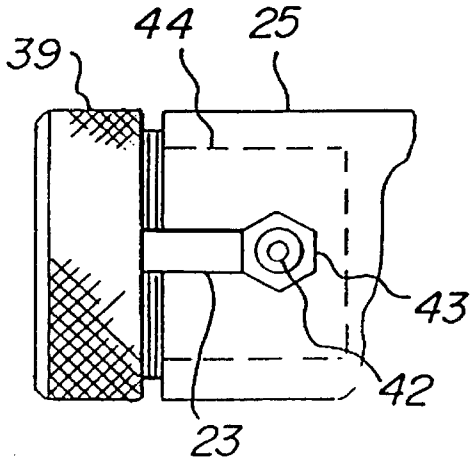
FIG. 2 is a bottom view of the spray gun barrel.
Figure 3:
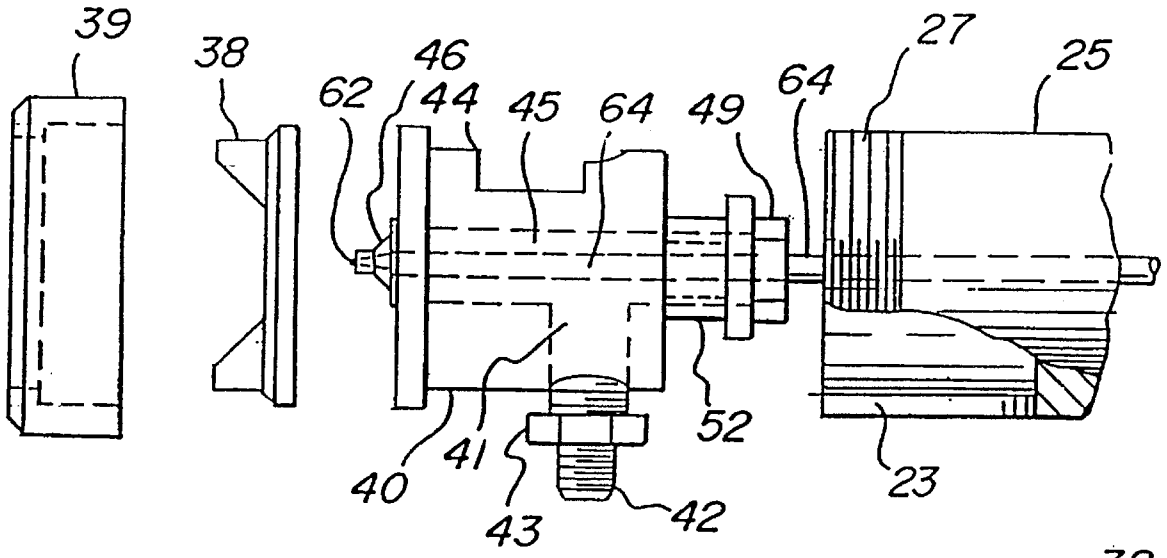
FIG. 3 is a expanded view showing the relationship of the parts.

The fluid flow assembly consists of all parts of the spray gun which is in contact with the fluid to be sprayed, with the exception of the needle valve and reservoir. The fluid flow assembly consists of a fluid reservoir fitting 42 attached by a threaded bore located at the bottom of the fluid flow block 44 (FIG. 3). The reservoir which stores the fluid to be sprayed is not shown. The reservoir is attached to the spray gun by the threaded fluid reservoir fitting 42. FIG. 2 shows the reservoir fitting 42 at the bottom of the gun, along with a reservoir fitting nut 43, which is used to secure the reservoir fitting to the bottom of the barrel. FIG. 2 is a bottom view of the barrel 25. A slot 23 on the bottom of the barrel extends from the front of the barrel toward the back of the barrel. When the fluid flow assembly is inserted into the barrel, the reservoir fitting 42 extends through the slot 23. In FIG. 2 the fluid flow block 44 is shown in dotted line. The locking ring 39 secures the fluid flow assembly in the barrel of the spray gun.

Figure 10:
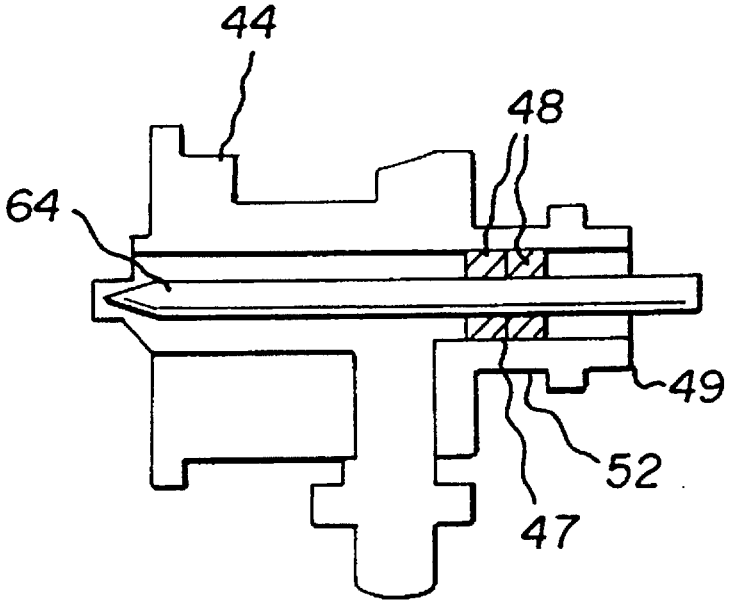
FIG. 10 is a cross section of a median view of the fluid flow block.

FIG. 3 shows the fluid flow block 44 which contains a right-angle passage 41 through which the pressurized fluid flows through the reservoir fitting 42 and through the nozzle 46. The nozzle 46 is attached by a threaded bore to the fluid flow block. A needle valve bore 45 pierces the fluid flow block so that the needle valve 64 may be extended through the needle valve bore 45 with the needle valve point 62 in interaction with the nozzle 46. Extension of the needle valve point 62 into the nozzle 46 closes the nozzle orifice. Retraction of the needled valve point opens the nozzle orifice and allows spraying of the fluid. A packing gland is located at the rear of the fluid assembly block in the cylindrical extension 52. One or more sealing 48 FIG. 10 rings are located in the packing gland 47 FIG. 10. The sealing rings seal around the needle valve shaft and prevent flow of fluid out of the fluid flow assembly. A cylindrical extension 52 extends from the rear of the fluid flow assembly and surrounds the needle valve bore. The cylindrical extension is threaded internally. A packing adjustment nut 49, having a bore for passage of the needle valve shaft through the nut, is threaded into the cylindrical extension and compresses the sealing ring or rings. When the fluid flow assembly is mounted in the gun, the cylindrical extension extends through the barrel back bore 29 (FIG. 1) which is a hole in the back of the spray gun barrel, and the packing adjustment nut 49 is threaded into the cylindrical extension. The packing adjustment nut thus is external to the barrel and may be adjusted without removal of the fluid flow assembly from the spray gun.

The needle valve thus extends from the nozzle 46 where the needle valve point 62 forms a seal with the internal side of the nozzle, back through the fluid flow assembly 40, through the packing gland and its sealing ring or rings, and through the packing adjustment nut 49. A trigger stop on the needle valve shaft 64 transmits the movement of the trigger to the movement of the needle valve. Rearward movement of the trigger opens the needle valve. The needle valve shaft 64 passes into the spray gun body through a needle valve grommet 34, which prevents escape of air from the spray gun body.

FIG. 1 shows the fluid flow assembly fitted into the barrel 25 where it is secured in position by an air horn 38. The air horn 38 is retained in the spray gun by a locking ring 39 which is screwed onto a threaded portion (27 on FIG. 3) on the outside of the spray gun barrel 25.

FIG. 3 shows the relationship between the barrel 25, fluid flow block 44, needle valve shaft 64 and needle valve point 62, air horn 38, locking ring 39, . Also shown is the barrel slot 23, reservoir fitting 42, and reservoir fitting nut 43. The fluid flow block 40 is shown with the right-angle passage 41 through which the pressurized fluid flows, and the needle valve bore 45 which pierces the fluid flow block so that the needle valve 64 may be extended through the needle valve bore 45 with the needle valve point 62 in interaction with the nozzle 46.

Figure 4:
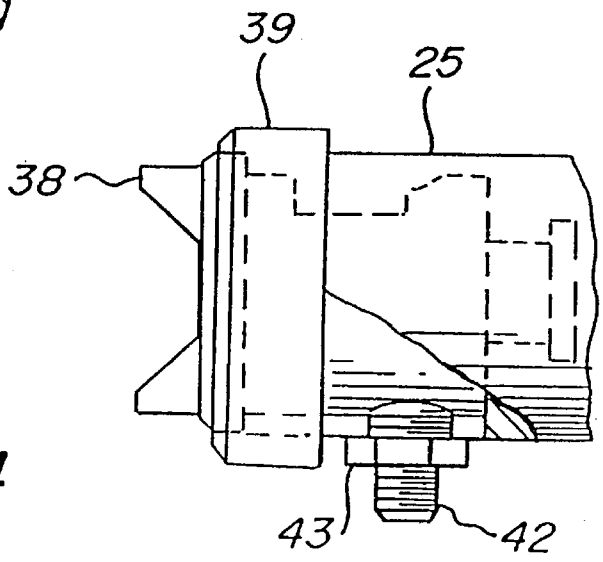
FIG. 4 is a side view of the end of the assembled spray gun.

FIG. 4 is a side view of end of the assembled spray gun. The air horn 38 protrudes from the front of the gun and is secured by the locking ring 39 to the barrel 25. Visible at the bottom of the barrel are the reservoir fitting 42 and reservoir fitting nut 43.

FIG. 5 shows a second embodiment of the spray gun in which a the fluid flow assembly, air horn 38, and locking ring 39 are combined in a cylindrical housing 232 to form a detachable spray assembly 230. The reservoir fitting 42 and reservoir fitting nut are visible at the bottom of the spray assembly 230. The cylindrical housing is attached to a cylindrical ring 234 which fits into the barrel 225. The detachable spray assembly 230 is secured to the barrel 225 by a boss 236 which protrudes from the cylindrical ring 234 and fits into a L-shaped slot 238 cut into the end of the barrel 225. Rotation of the detachable spray assembly relative to the barrel secures the detachable spray assembly to the barrel. FIG. 6 shows the detachable spray assembly 230 secured to the barrel 225 by the boss 236 in the L-shaped slot 238.

The embodiment of FIGS. 5 and 6 provides the advantage of rapid changing of the spray assembly. This is of advantage when it is desired to quickly change a dirty spray assembly for a clean one, or when it is desired to rapidly change to a spray assembly having different spraying characteristics.

FIG. 7 shows a third embodiment of the spray gun in which the locking ring 139 is secured to the barrel 125 by a bayonet latch. Two curved lugs 140 arrayed about the circumference of the locking ring 139 fit into notches 142 cut into the circumference of end surface 146 of the barrel 125. Rotation of the locking ring 139 moves the lugs 140 into mortises cut into the internal surface of the barrel, locking the locking ring to the barrel in an air-tight seal. The air horn and fluid flow assembly are thereby secured to the barrel.

FIG. 8 is a diagram showing the lugs 140 of locking ring 139 in the notches 142 in the end surface 146 of the barrel 125. Rotation of the locking ring relative to the barrel results in the locked configuration shown in FIG. 9 in which the lugs are not visible behind the end surface 146 of the barrel 125. The notches 142 are visible.

The bayonet latch allows rapid removal and reassembly of the locking ring, while maintaining an air-tight seal between the locking ring and the barrel.

It will be apparent to those skilled in the art that the examples and embodiments described herein are by way of illustration and not of limitation, and that other examples may be used without departing from the spirit and scope of the present invention, as set forth in the appended claims.

I claim:

1. In a spray gun of the class wherein the flow of pressurized fluid through a fluid flow assembly located in the spray gun barrel is controlled by a needle valve which interacts with a nozzle, and whose needle valve shaft passes through a packing gland in said fluid flow assembly, and which needle valve is controlled by a trigger, the improvement comprising:

a fluid flow assembly which is removable for cleaning, said fluid flow assembly comprising a fluid flow block having a fluid reservoir fitting for attachment of a fluid reservoir, a right angle passage through which fluid flows, a nozzle attached to the fluid flow block, a needle valve bore which pierces the fluid flow block for accommodation of a needle valve shaft, a cylindrical extension located at the rear of the fluid flow block, and a packing gland in the cylindrical extension for sealing a needle valve shaft, locking means for securing the fluid flow assembly in the spray gun barrel, and a packing gland adjustment means located external to the spray gun barrel.

2. In a spray gun of the class wherein the flow of pressurized fluid through a fluid flow assembly located in the spray gun barrel is controlled by a needle valve which interacts with a nozzle, and whose needle valve shaft passes through a packing gland in said fluid flow assembly, and which needle valve is controlled by a trigger, the improvement comprising:

a fluid flow assembly which is removable for cleaning, said fluid flow assembly comprising a fluid flow block having a fluid reservoir fitting for attachment of a fluid reservoir, a right angle passage through which fluid flows, a nozzle attached to the fluid flow block, a needle valve bore which pierces the fluid flow block for accommodation of a needle valve shaft, a cylindrical extension located at the rear of the fluid flow block and a packing gland in the cylindrical extension for sealing a needle valve shaft, and, a packing gland adjustment means located external to the spray gun barrel.

* * * * *